US005752140A

United States Patent [19]

Danzuka et al.

[11] Patent Number: 5,752,140

[45] Date of Patent: *May 12, 1998

[54] DEVELOPING DEVICE USING DEVELOPMENT BIAS HAVING OSCILLATING PART AND A QUIESCENT PART

[75] Inventors: Toshimitsu Danzuka, Tokyo; Yuji Sakemi, Inagi; Hisashi Fukushima, Kawasaki; Takeshi Menjo, Tokyo, all of Japan

[ * ] Notice: The term of this patent shall not extend beyond the expiration date of Pat. No. 5,242,812.

[73] Assignee: Canon Kabushiki Kaisha, Japan

[21] Appl. No.: 358,730

[22] Filed: Dec. 19, 1994

[30] Foreign Application Priority Data

| | | | |
|---|---|---|---|
| Dec. 27, 1993 | [JP] | Japan | 5-348361 |
| Apr. 19, 1994 | [JP] | Japan | 6-104754 |
| Apr. 19, 1994 | [JP] | Japan | 6-104755 |

[51] Int. Cl.[6] ..... G03G 15/09

[52] U.S. Cl. ..... 399/270

[58] Field of Search ..... 355/245, 246; 399/55, 270, 285

[56] References Cited

U.S. PATENT DOCUMENTS

| | | | |
|---|---|---|---|
| 4,610,531 | 9/1986 | Hayashi et al. | 355/246 |
| 4,777,107 | 10/1988 | Kurematsu et al. | 130/122 |
| 4,844,008 | 7/1989 | Sakemi et al. | 118/658 |
| 4,883,019 | 11/1989 | Menjo et al. | 118/691 |
| 5,177,536 | 1/1993 | Watanabe et al. | 355/251 |
| 5,225,872 | 7/1993 | Fukushima | 355/208 |
| 5,239,343 | 8/1993 | Sakemi et al. | 355/253 |
| 5,267,007 | 11/1993 | Watanabe et al. | 355/245 |
| 5,287,148 | 2/1994 | Sakemi et al. | 355/245 |
| 5,294,967 | 3/1994 | Munakata et al. | 355/326 |
| 5,422,706 | 6/1995 | Tsunemi et al. | 355/211 |
| 5,424,812 | 6/1995 | Kemmochi et al. | 399/270 |
| 5,519,471 | 5/1996 | Nishimura et al. | 355/246 |

*Primary Examiner*—Fred L. Braun

*Attorney, Agent, or Firm*—Fitzpatrick, Cella, Harper & Scinto

[57] ABSTRACT

An image forming apparatus having an image carrying member for carrying an electrostatic image, fluororesin has a surface layer containing a fluororesin, and a developing device for developing the electrostatic image on the image carrying member. The image carrying member has a surface layer containing a fluororesin. The developing device has a developer carrying member, which is arranged as opposed to the image carrying member and which carries a developer, and a bias applying device for applying a development bias voltage to the developer carrying member. A period of a waveform of the bias voltage applied by the bias applying device has an oscillating part and a quiescent part.

9 Claims, 12 Drawing Sheets

DEVELOPING DEVICE USING DEVELOPMENT BIAS HAVING OSCILLATING PART AND A QUIESCENT PART

BACKGROUND OF THE INVENTION

1. Field of the Invention

The present invention relates to a developing device used in an image forming apparatus such as copiers, printers, etc.

2. Related Background Art

It is a general for image forming apparatus of the electrophotographic method or the electrostatic recording method for development to be carried out while keeping a development sleeve carrying a developer opposed to an image carrying member carrying an electrostatic image.

A development bias is applied to the development sleeve in order to form a development electric field between the image carrying member and the development sleeve.

A popularly used development bias is one as shown in FIG. 2 in which an AC component is superimposed on a DC component.

The rectangular wave shown in FIG. 2 can achieve a high development efficiency even with a low peak-to-peak voltage.

The development bias as shown in FIG. 2, however, has a drawback that a highlight portion of an image is "roughened". To overcome the drawback, the present applicant proposed a development bias in which the DC component and AC component were intermittently superimposed, for example as shown in FIG. 3.

The development bias as shown in FIG. 3, however, had the following problems.

The development bias as shown in FIG. 3 (a blank pulse bias; hereinafter referred to as a BP bias) has a better developability than the development bias as shown in FIG. 2 (hereinafter referred to as a rectangular bias), whereas the BP bias requires a lower contrast (difference between a potential of an electrostatic latent image on the electrostatic latent image carrying member and the DC component in the development bias; hereinafter referred to as $V_{cont}$) than the rectangular bias in order to gain an image density (hereinafter referred to as OD), which causes a problem of inconsistencies in potential of electrostatic latent image.

According to the experiments conducted by the inventors of the present application, $\gamma(=\Delta OD/\Delta V_{cont})$ in use of the BP bias shown in FIG. 3 was 1.8 to 2.3 times (which changes depending upon the environmental temperature and humidity) greater than that in use of the rectangular bias shown in FIG. 2. Namely, density inconsistencies appearing for same potential inconsistencies are 1.8 to 2.3 times greater with the BP bias shown in FIG. 3 than those with the rectangular bias shown in FIG. 2.

Accordingly, using the BP bias, it is required to control the potential inconsistencies of electrostatic latent image so as to be smaller than those in use of the rectangular bias.

Meanwhile, the photosensitive member as an electrostatic latent image carrying member becomes shaved mainly in a cleaning step in the electrophotographic process as being repetitively used. In this case, a shaving amount differs depending upon a pressure distribution of a cleaning device against the photosensitive member, a distribution of toner image developed on the photosensitive member, etc.. It is thus difficult to construct the apparatus so as to shave the photosensitive member without nonuniformity, so that inconsistencies are inevitable in the thickness of a surface layer of the photosensitive member.

The inconsistencies in the thickness of the surface layer of the photosensitive member normally result in inconsistencies in the electrostatic latent image formed on the photosensitive member.

With same photosensitive members having a same surface layer, inconsistencies outside an allowable range appear about 1.8 to 2.3 faster (or with outputs of a smaller number of images) on an image in the case of the BP bias than in the case of the rectangular bias accordingly. By that amount, an exchange cycle of photosensitive member or the life of photosensitive member becomes shorter, which was another problem.

On the other hand, it is known that to add a fluororesin in the surface layer of photosensitive member is effective in improving surface lubricity thereof, and is thus effective in improving cleanability and in controlling the shaving amount of photosensitive member.

The addition of fluororesin in the surface layer of photosensitive member, however, causes a drawback that the highlight portion of image is "roughened". This "roughness" of the highlight portion also increases with repetitive use of developer, and, compensate, the image quality has been maintained by an ordinary method of periodic exchange of developer.

Namely, the addition of fluororesin in the surface layer of photosensitive member was able to control the shaving amount of photosensitive member, whereas another problem that the life of developer was shortened because of the deterioration of "roughness" in the highlight portion of image was present on the other hand.

SUMMARY OF THE INVENTION

It is an object of the present invention to provide a developing device preventing the density inconsistencies.

It is another object of the present invention to provide a developing device preventing the highlight portion from being roughened.

It is still another object of the present invention to provide an image forming apparatus improved in cleanability and reduced in shaving amount of photosensitive member.

It is still another object of the present invention to provide a developing device comprising:

an image carrying member for carrying an electrostatic image, said image carrying member having a surface layer containing a fluororesin; and developing means for developing an electrostatic image on said image carrying member, said developing means having a developer carrying member for carrying a developer as opposed to said image carrying member, and bias applying means for applying a development bias to said developer carrying member;

wherein a cycle of a waveform of the bias voltage applied to said bias applying means has an oscillating part and a quiescent part.

Further objects of the present invention will be apparent in the following description.

DESCRIPTION OF THE PREFERRED EMBODIMENTS

The embodiments of the present invention will be described in the following.

Figure 1:
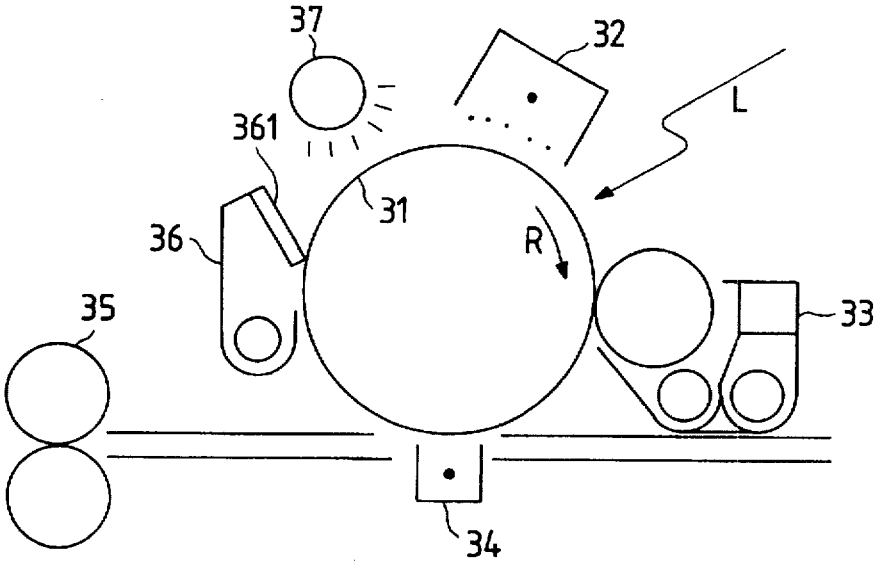
FIG. 1 is a drawing to show an image forming apparatus of the electrophotographic method embodying the present invention.

FIG. 1 is a schematic, structural drawing of an image forming apparatus to which a developing device of an embodiment of the present invention is applied.

In FIG. 1, a photosensitive drum 31 as an electrostatic latent image carrying member rotates in the direction of the arrow R in the drawing and the surface thereof is uniformly charged by a primary charging device 32. After that, the photosensitive drum 31 is exposed to laser light (represented by the arrow L in the drawing) associated with an image, whereby an electrostatic latent image is formed thereon. The electrostatic latent image is developed by a developing device 33 enclosing a two-component developer composed of toner and carrier so as to be visualized. The thus visualized toner image is transferred onto a sheet conveyed by a sheet conveying apparatus not shown, by a transfer charging device 34, and thereafter the transferred image is fixed by a fixing device 35 to be output as an image. Untransferred toner remaining on the photosensitive drum 31 in the transfer step is cleaned by a cleaning apparatus 36 having a cleaning blade 361 urged against the photosensitive drum 31. After that, the photosensitive drum 31 is discharged by a pre-exposure apparatus 37 and then is subjected to another image formation.

Figure 4:
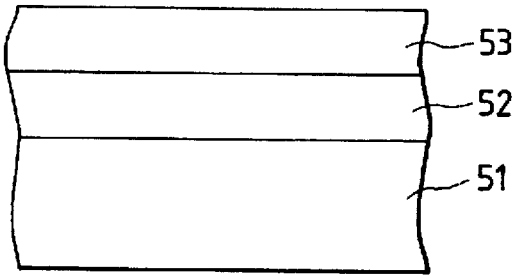
FIG. 4 is an explanatory drawing to show a schematic layer structure of a photosensitive drum employed in the first embodiment.

FIG. 4 shows the schematic layer structure of the photosensitive drum in the present embodiment. As shown in FIG. 4, the photosensitive drum is composed of a conductive base 51, a charge generating layer 52 laid thereon, and a charge transfer layer 53 laid further thereon. In the present embodiment, 30% of Teflon (trade name), which is a fluororesin, is dispersed in the charge transfer layer 53 (main binder; polycarbonate), which is a surface layer of the photosensitive drum.

Figure 3:
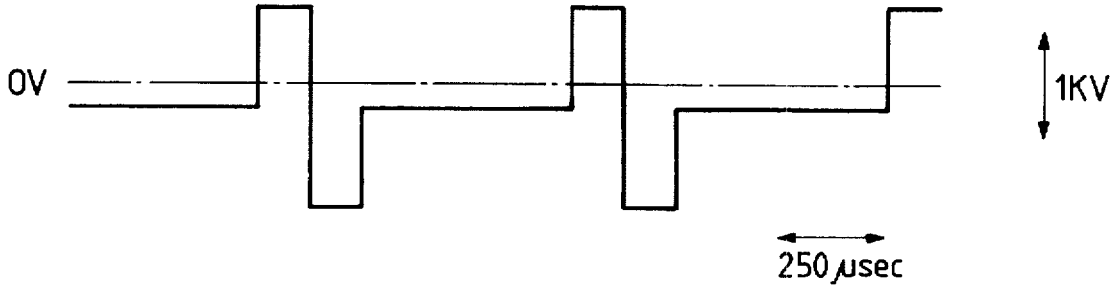
FIG. 3 is a waveform diagram to show a BP bias.

Further, the development bias in the present embodiment is the same BP bias having the oscillating part and the quiescent part in a cycle as shown in FIG. 3.

The following Table 1 shows comparison results with prior art apparatus, of photosensitive drum life and developer life when repetitive image outputs (hereinafter referred to as durability test) were conducted using the image forming apparatus arranged in the above structure. In Table 1, the photosensitive drum life and the developer life each are defined as 1 for the case where the photosensitive drum including no Teflon (trade name) and the rectangular bias shown in FIG. 2 were used.

TABLE 1

Figure 2:
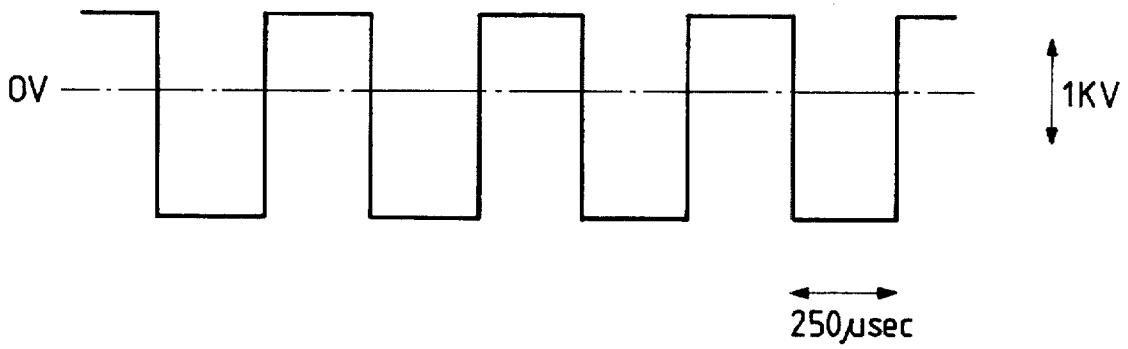
FIG. 2 is a waveform diagram to show a rectangular bias.

| | Teflon content | | | |
|---|---|---|---|---|
| | 0% (prior art) | | 30% | |
| development bias | drum life | developer life | drum life | developer life |
| rect. bias of FIG. 2 (prior art) | 1 | 1 | 3–3.5 | 0.7–0.8 |
| BP bias of FIG. 3 | 0.5–0.7 | 2.5–3 | 1.5–2.4 | 1.7–2.4 |

As shown in Table 1, the change only of the development bias from the rectangular bias shown in FIG. 2 to the BP bias shown in FIG. 3 can extend the developer life 2.5 to 3 times but shortens the photosensitive drum life 0.5 to 0.7 times, resulting in increasing the running cost which is the major part of service cost.

On the other hand, the dispersion of 30% Teflon in the surface layer of photosensitive drum with using the rectangular bias shown in FIG. 2 as the development bias can extend the photosensitive drum life 3 to 3.5 times but shortens the developer life 0.7 to 0.8 times, also resulting in increasing the running cost.

Then, employing the arrangement that 30% of Teflon was dispersed in the surface layer of photosensitive drum and the development bias was changed from the rectangular bias shown in FIG. 2 to the BP bias shown in FIG. 3, the photosensitive drum life was extended 1.5 to 2.4 times and the developer life was also extended 1.7 to 2.4 times.

As described above, it was found that to use the BP bias as the development bias when the photosensitive drum having the surface layer containing the fluororesin was used or to add the fluororesin in the surface layer of photosensitive drum when the BP bias was used as the development bias was effective in reducing the running cost.

Exchanging the photosensitive drum and developer for a new drum and developer in a same period as in the conventional apparatus, high-quality images can be maintained with less "roughness" of the highlight portion of image and with less image inconsistencies due to nonuniform shaving of the photosensitive drum than those in the conventional apparatus.

Embodiment 2

Figure 5:
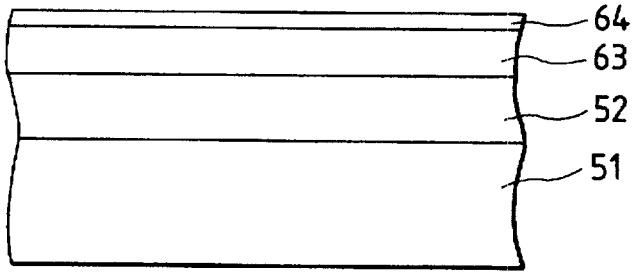
FIG. 5 is an explanatory drawing to show a schematic layer structure of a photosensitive drum employed in the second embodiment.

The second embodiment of the present invention is next described referring to FIG. 5. FIG. 5 shows the schematic layer structure of a photosensitive drum used in the present embodiment. Elements denoted by the same reference numerals as those in FIG. 4 designate the same elements and therefore are omitted to explain herein.

As shown in FIG. 5, the photosensitive drum of the present embodiment is composed of a conductive base 51, a charge generating layer 52 laid thereon, a charge transfer layer 63 laid further thereon, and a protective layer 64 laid further thereon. No Teflon is dispersed in the charge transfer layer 63 in the present embodiment. Instead, 30% of Teflon (trade name) is dispersed in the protective layer 64 (main binder; polycarbonate).

The following Table 2 shows results of the same durability test as in the first embodiment, using the image forming apparatus shown in FIG. 1 and the above photosensitive drum.

TABLE 2

| | Teflon content | | | |
|---|---|---|---|---|
| | 0% (no protective layer; prior art) | | 30% (with protective layer) | |
| development bias | drum life | developer life | drum life | developer life |
| rect. bias of FIG. 2 (prior art) | 1 | 1 | 3.5–4 | 0.7–0.8 |
| BP bias of FIG. 3 | 0.5–0.7 | 2.5–3 | 1.7–2.8 | 1.7–2.4 |

As apparent from Table 2, the photosensitive drum life became about 15% longer by provision of the protective layer (containing 30% Teflon) than in the previous embodiment.

It is considered that this is because an amount of inconsistencies in potential of electrostatic latent image decreased with respect to a shaving amount of the photosensitive drum.

Using such a photosensitive drum, the effects of decreased roughness and decreased image inconsistencies can also be achieved similarly as in the first embodiment.

Embodiment 3

Although the first and second embodiments used the BP bias shown in FIG. 3 as the development bias, the development bias effective to the present invention is not limited to the BP bias shown in FIG. 3.

Figure 6:
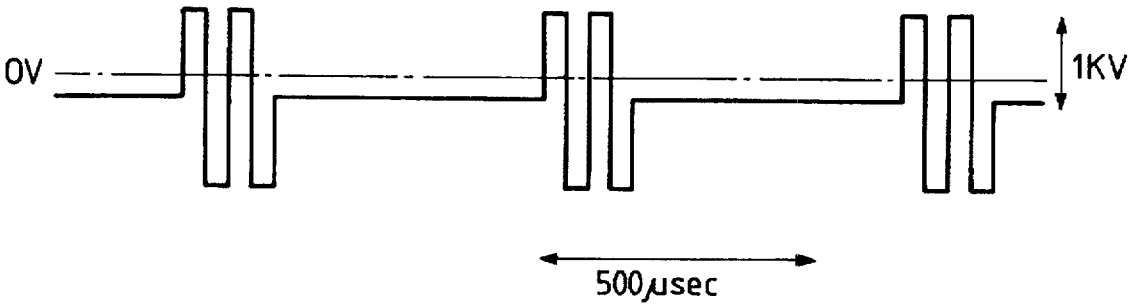
FIG. 6 is a waveform diagram of a development bias employed in the third embodiment.

FIG. 6 shows a development bias used in the present embodiment. In the development bias shown in FIG. 6, each oscillating part includes a plurality of oscillations. This development bias has an advantage that a change amount of image density relative to a change of toner density in the developer is smaller than that by the development bias shown in FIG. 3.

Using such a development bias, the effects of decreased roughness and decreased image inconsistencies can also be achieved similarly as in the first and second embodiments.

Still another embodiment of the present invention is described in the following.

Figure 7:
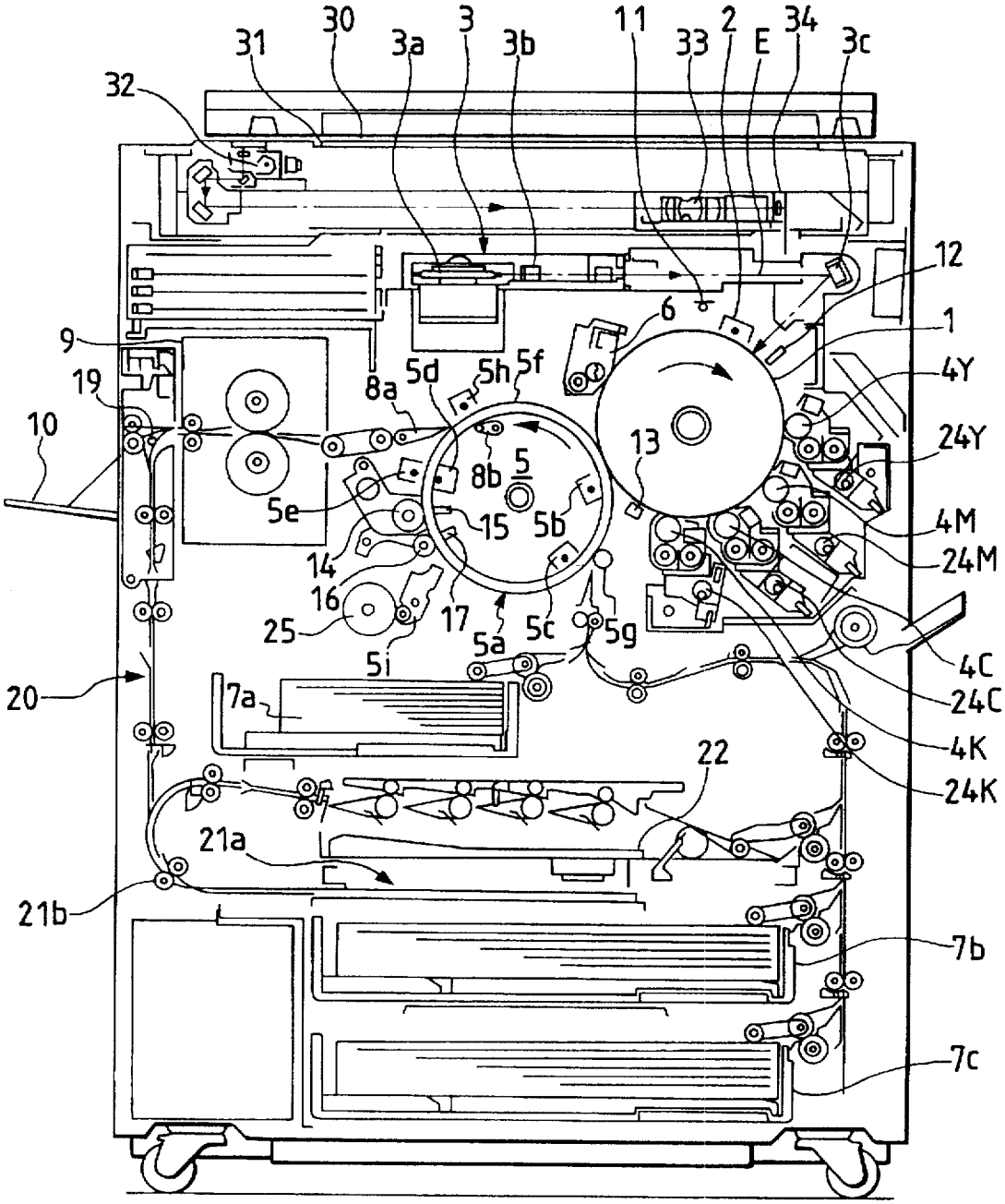
FIG. 7 is a cross-sectional view of another image forming apparatus to which an embodiment of the present invention can be applied.

FIG. 7 is a cross-sectional view of an image forming apparatus in the still another embodiment of the present invention.

The color image forming apparatus shown in FIG. 7 has a digital color image reader portion in the upper portion thereof and a digital color image printer portion in the lower portion thereof.

In the reader portion, an original document 30 is set on an original glass 31 and an image of reflected light from the original 30, obtained by exposure scanning thereof with an exposure lamp 32, is focused by a lens 33 on a full color sensor 34 to obtain color-separated image signals. The color-separated image signals are amplified by an amplifying circuit not shown and thereafter are processed in a video processing unit not shown either, then being sent to the printer portion.

In the printer portion, the photosensitive drum 1 as an image carrying member is a photosensitive member having a surface protective layer as described later, which is supported as rotatable in the direction of the arrow in the drawing. Around the photosensitive drum 1 there are a pre-exposure lamp 11 for initializing the surface of the photosensitive drum 1, a charging device 2 (a corona charger in this example) for uniformly charging the surface of the photosensitive drum 1, a laser exposure optical system 3 for forming an electrostatic latent image according to image information on the photosensitive drum 1, a potential sensor 12 for detecting a potential of the surface of the photosensitive drum 1, a developing device arranged as fixed, composed of four developing units 4C, 4M, 4Y, 4K enclosing different color developers (toners) for developing an electrostatic latent image formed on the photosensitive drum 1 into a visible image, a photo detecting means 13 for detecting a toner amount on the photosensitive drum 1, a transferring device 5 including a transfer drum **5*a* as a recording medium carrier, a cleaner 6 for removing developers remaining on the photosensitive drum 1**, etc..

In this example, the laser exposure optical system 3 is composed of a polygon mirror **3*a*, a lens 3*b*, a mirror 3*c*, etc., as so arranged that laser light E is modulated according to a color image signal for each color as color-separated, from the reader portion, the modulated light is converted into a light signal of image scan exposure in a laser output portion, and the converted laser light E is reflected by the polygon mirror 3*a* and that the reflected light is projected through the lens 3*b* and mirror 3*c* onto the surface of the photosensitive drum 1** to form an electrostatic latent image corresponding to each color image signal.

Upon forming an image in the printer portion, the photosensitive drum is rotated in the direction of the arrow in the drawing and, first, the surface of the photosensitive drum 1 is discharged by the pre-exposure lamp 11 to be initialized. Next, the charging unit 2 uniformly charges the surface of the photosensitive drum 1 with negative charge, and then light images E corresponding to the respective image signals color-separated by the image exposure means 3 are successively projected onto the surface of the photosensitive drum 1, thereby forming corresponding electrostatic latent images one by one in the predetermined color order.

Next, predetermined developing units are successively operated in the order of cyan (C), magenta (M), yellow (Y), and black (K), which is a predetermined development order, to develop each of the corresponding latent images on the photosensitive drum 1, thereby successively forming associated toner images with negative toners the base of which is a resin, on the photosensitive drum 1. Here, the developing units 4C, 4M, 4Y, 4K in the developing device are so arranged that in accordance with a color of a formed latent image, a required developing unit approaches the photosensitive drum 1 in an alternative way to perform a development operation through an operation of eccentric cam 24C, 24M, 24Y, 24K.

On the other hand, a recording medium, such as a transfer sheet fed from a recording medium cassette 7a, 7b or 7c (or by hand) by a conveying system composed of a pickup roller, a sheet feed guide, a sheet feed roller, etc., is wound around the transfer apparatus 5 in synchronization with a predetermined timing. The transfer apparatus 5 in this example has a transfer drum 5a in diameter of 180 mm as a recording medium carrier, a transfer corona charger 5b for transferring a toner image on the photosensitive drum 1 onto a recording medium, an adhesion corona charger 5c and an adhesion (contact) roller 5g as an opposite pole, which is adhesion charging means for adhering the recording medium to the transfer drum 5a, an inner corona charger 5d, and an outer corona charger 5e, in which a peripheral opening area of the transfer drum 5a supported as rotatable is covered by a recording medium carrying sheet 5f as recording medium carrying means made of a dielectric in the shape of integral cylinder. This recording medium carrying sheet 5f is a dielectric sheet such as a polycarbonate film etc..

The transfer drum 5a is rotated in the direction of the arrow in the drawing in synchronization with the photosensitive drum 1, and a cyan toner image developed by the cyan developing unit 4C is transferred by the transfer charger 5b in the transfer portion onto a recording medium carried on the recording medium carrying sheet 5f. Then the transfer drum 5b continues rotating to get ready for a next color (for example magenta) image.

The photosensitive drum 1 after transfer of the toner image is cleaned by the cleaner 6 to remove deposits such as residual toner and again is uniformly charged by the charger 2 to be subjected to image exposure as described above with laser light modulated according to the next magenta image signal. This magenta latent image is developed by the magenta developing unit 4M to form a magenta toner image. This magenta toner image is transferred by the transfer charger 5b in the transfer portion onto the recording medium carried on the recording medium carrying sheet 5f, thereby superimposing the magenta toner image on the cyan toner image. The transfer drum 5b continues rotating to get ready for transfer of a next color (for example yellow) image.

Subsequently, the above process is repeated for formation and transfer of yellow and black images. After completion of superimposition transfer of four color toner images, the recording medium is discharged by a separation charger 5h and then is separated from the transfer drum 5a by an action of a separation push roller 8b and a separation pawl 8a. The thus separated recording medium is sent to a fixing device (which is a heat roller fixing device in this example) 9 by the conveying means, where the color images are fixed all together. The thus fixed recording medium is discharged onto an external tray 10. The serial full color print sequence is thus completed to form a desired full color print image.

Next, where images are to be formed on the both surfaces of recording medium, a conveyance path changeover guide 19 is driven immediately after the recording medium is discharged from the fixing device 9, whereby the recording medium is once guided through a vertical conveyance path 20 to a reversing path 21a. After that, reversing a reversing roller 21b, the recording medium is guided backward in the direction opposite to the fed direction in such a manner that the rear edge of the recording medium when fed thereto becomes a leading edge, and is then stored in an intermediate tray 22. Then the recording medium is again conveyed from the intermediate tray 22 to the transfer apparatus 5, and an image is formed on the other surface by the above-described image forming steps.

In order to prevent scattering and deposition of powder on the recording medium carrying sheet 5f of transfer drum 5a, deposition of oil on the recording medium, etc., cleaning is carried out through an action of a fur brush 14 and a backup brush 15 as opposed to the fur brush 14 with the recording medium carrying sheet 5f inbetween and through an action of an oil removing roller 16 and a backup brush 17 as opposed to the oil removing roller 16 with the recording medium carrying sheet 5f inbetween. Such cleaning is carried out before or after image formation or upon occurrence of jamming (sheet plugging) with necessity.

In this example, an eccentric cam 25 is operated at a desired timing to actuate a cam follower 5i incorporated with the transfer drum 5a, whereby a gap can be arbitrarily set between the recording medium carrying sheet 5f and the photosensitive drum 1. For example, the gap between the transfer drum 5a and the photosensitive drum 1 is enlarged during standby (waiting) or in the power off state.

Figure 8:
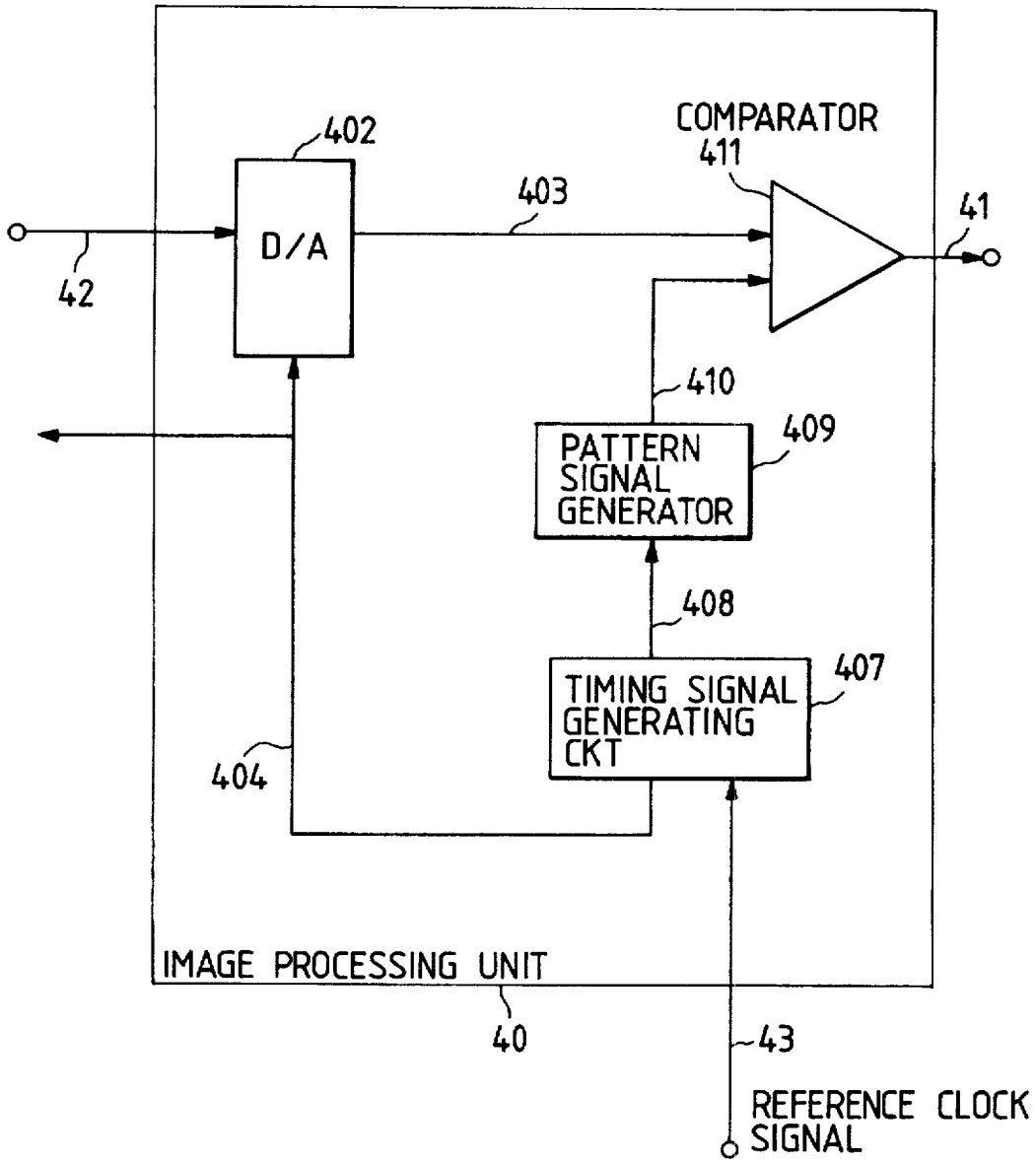
FIG. 8 is a block diagram to show an image processing unit in a color image forming apparatus of FIG. 7.

The image processing process of the image processing unit 40 is next described referring to the block diagram of FIG. 8. The same portions as those in FIG. 7 are denoted by the same reference numerals.

The digital image data 42 is converted into an analog image signal 403 by a D/A converter 402 and the analog image signal 403 is put into one terminal of comparator 411. Numeral 407 designates a timing signal generating circuit, which receives a reference clock signal 43 to produce a picture element clock 404 and a screen clock 408 for a pattern signal generator 409 and then to output them. The pattern signal generator 409 outputs a pattern signal 410 based on the screen clock 408 to put it into the other terminal of comparator 411.

The digital image data 42 is put into the D/A converter 402 in synchronization with the picture element clock 404, and the D/A converter outputs the analog image signal 403 in synchronization with the picture element clock 404. The screen clock 408 is a clock signal of an integral multiple of the picture element clock 404, which determines the period of pattern signal 410 for example a triangular wave.

The comparator 411 compares the analog image signal 403 with the pattern signal 410. The comparator outputs 0 if the analog image signal 403 is greater but 1 if it is smaller, thus producing binary image data 41 modulated in pulse width and outputs it.

Figure 9:
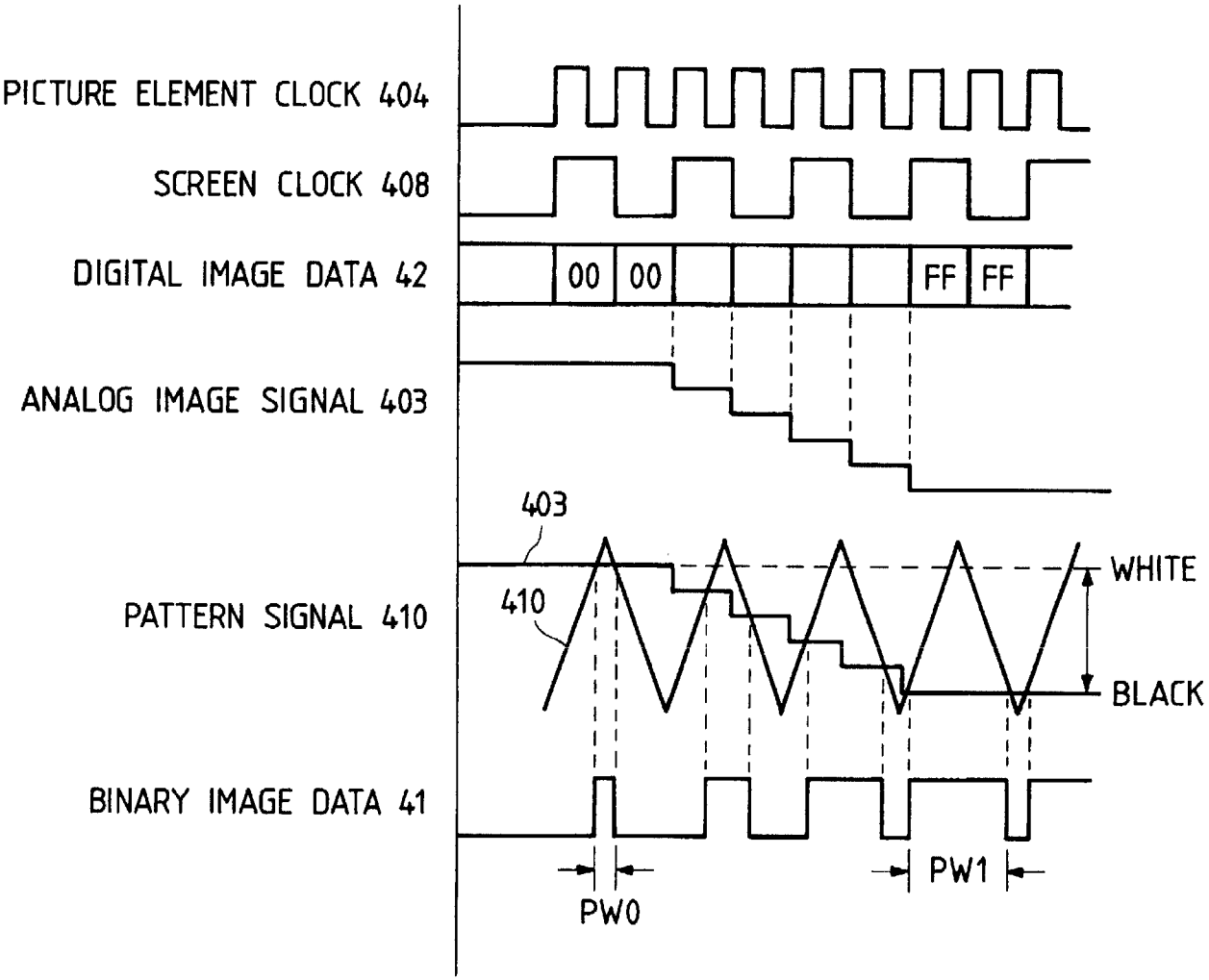
FIG. 9 is a timing chart of the image processing unit of FIG. 8.

The image processing process is further described using the timing chart of FIG. 9 showing timings in the respective parts in FIG. 8.

Here, the screen clock 408 is a clock having a period of two times the pixel clock 404. When the digital image signal changes stepwise from the hexadecimal digit 00 (white) to the digit FF (black), a pulse waveform of the binary image data 41 modulated in pulse width by the pattern signal 410 is shown. Thus changing the amplitude of pattern signal 410, a relation can be changed between the input level of digital image data 42 and the pulse width of binary image data 41.

The binary image data of data 41 is put into the image forming portion of the full color copier. Controlling an exposure width with laser light, a laser spot with the exposure width according to the image data is projected onto the photosensitive member to form a latent image thereon. Each latent image is developed by the developing unit 4Y, 4C, 4M, 4K as described previously.

The development step, which is a feature of the present invention, is next described in detail. The developer is a two-component developer composed of nonmagnetic toner and magnetic powder (carrier). A mixing ratio is adjusted in about 5% of nonmagnetic toner by weight. The nonmagnetic toner has a volume-average particle size of about 8 μm. The magnetic powder consists of ferrite particles (maximum magnetization 60 emu/g) coated with a resin, which have a weight-average particle size of 50 μm and show a value of electrical resistivity not less than $10^8$ Ωcm. Further, the permeability of the magnetic powder is about 5.0.

An opening portion is provided in a portion of a development container near the photosensitive drum 1, and the development sleeve projects out of the opening portion. The development sleeve is incorporated as rotatable in the development container. The outer diameter of the development sleeve is 25 mm and a peripheral speed thereof is 280 mm/sec. The development sleeve is placed with a gap of 500 μm to the photosensitive drum 1.

In the present embodiment, an alternate voltage is applied as the development bias so that an alternating electric field satisfying the following condition is intermittently formed:

$$|V_{PP}-2V_{cont}|/16V_f^2<d^2/|Q|$$

where $V_{PP}$[V]: a peak-to-peak voltage of the alternating voltage on the developer carrying member;

$V_f$[Hz]: a frequency of the alternating voltage on the developer carrying member;

$V_{cont}$[V]: an image contrast potential (a potential difference from the latent image potential when a maximum image density is output from the DC voltage of development bias);

Q[C/kg]: an average triboelectricity of toner;

d[m]: a distance between the developer carrying member and the latent image carrying member.

Two types of toner are used in this example: one having an amount of triboelectricity of about $2.0\times10^{-2}$ C/kg and the other having that of about $3.0\times10^{-2}$ C/kg.

Figure 10:
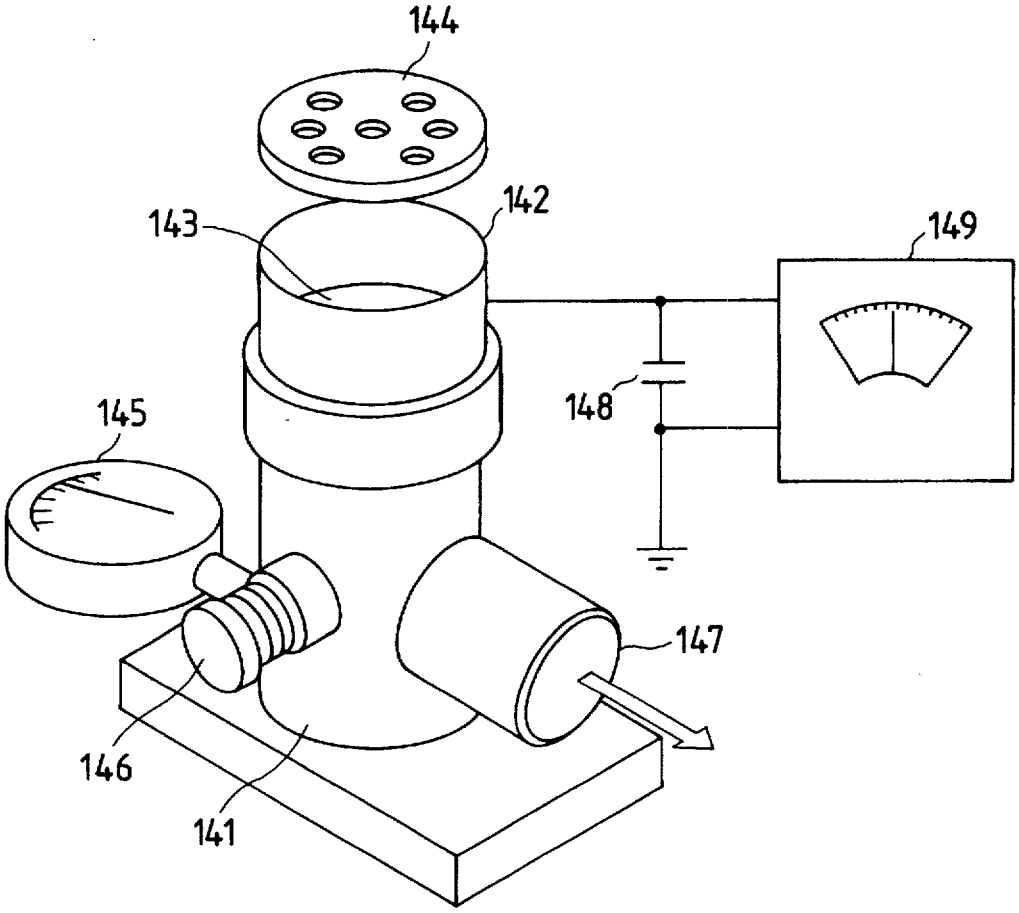
FIG. 10 is a structural drawing of a measurement apparatus for measuring an amount of frictional electrification of a two-component developer.

A method for measuring the amount of triboelectricity of toner (two-component developer) is next described referring to FIG. 10. FIG. 10 is an explanatory drawing to show an apparatus for measuring an amount of triboelectricity of toner.

First, a two-component developer to be measured in triboelectricity is put in a polyethylene bottle having a volume of 50 to 100 ml and the bottle with developer is shaken for about 10 to 40 seconds by hand. Then about 0.5 to 1.5 g of the developer is put into a metal measuring vessel 142 with a screen 143 of 500 meshes on the bottom, and a metal lid 144 is put thereon. The total weight of the measuring vessel 142 at this moment is measured and the measured weight is referred to as $W_1$ (kg). Next, an evacuator 141 (at least a portion contacting with the measuring vessel 142 being an insulator) is actuated to evacuate the air through an evacuation port 147 and an air-flow control valve 146 is adjusted to set the pressure of vacuum gage 145 to 250 (mmAq). Evacuation is continued in this state sufficiently, preferably for two minutes to evacuation-remove the resin. A potential of electrometer 149 at this time is referred to as V (V). Here, 148 is a capacitor, a capacitance of which is referred to as C (F). Further, the total weight of the measuring vessel 142 after evacuation is called as weight $W_2$ (kg). The triboelectricity amount (C/kg) of this toner is calculated as follows.

Triboelectricity amount of resin (C/kg)$=C\times V\times10^{-3}/(W_1-W_2)$.

In the present embodiment, a highlight halftone image with an image density of about 0.2 and a solid image were output to evaluate smoothness of the highlight halftone image and density of the solid image. Here, the formation of electrostatic latent image for outputting the above images was as follows. First, the photosensitive drum was uniformly charged at 650 V. For outputting the highlight halftone image, the PWM exposure (pulse width modulation) was carried out with semiconductor laser to lower the surface potential down to about 450 V; whereas, for outputting the solid image, the surface potential was lowered down to about 100 V ($V_{cont}$=400 V). (The present embodiment employed the inversion development.)

Next described is the development step carried out using the developing device having the above structure and the toner having the charge amount as described above.

Figure 11:
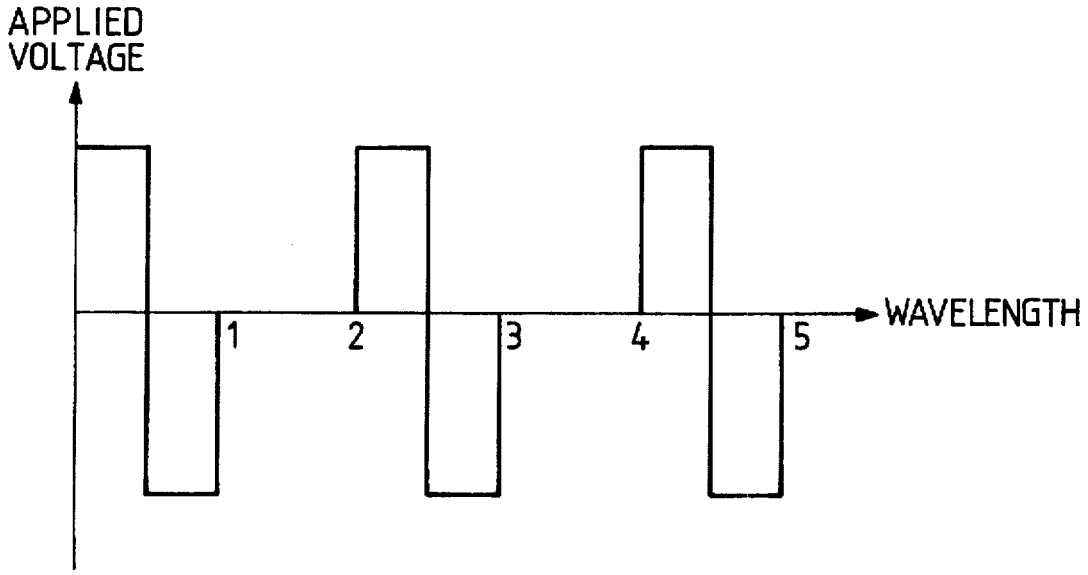
FIG. 11 is a waveform diagram to show an example of the development bias voltage in the present embodiment.

In the present embodiment, the image quality was evaluated for the output images under the above latent image conditions with the two types of toner triboelectricity of about $2.0\times10^{-2}$ C/kg and about $3.0\times10^{-2}$ C/kg as described above, while the DC voltage was set at 500 V, the amplitude $V_{PP}$ of the alternating voltage intermittently given was fixed at 2000 V, and the frequency $V_f$ was changed (in this case, a time period for which the alternating electric field was interrupted was a period per period of the alternating electric field, as shown in FIG. 11.)

As a result, as seen from the following Table 3, the reproducibility of highlight image was excellent while keeping the solid image at a high density, only if A<B where $A=|V_{PP}-2V_{cont}|/16V_f^2$ and $B=d^2/|Q|$.

TABLE 3

| Tribo-elec. | $V_f$ | solid density | high light image qual. | (A) $\{\|V_{PP}-2V_{cont}\|\}/16V_f^2$ | (B) $d^2/Q$ |
|---|---|---|---|---|---|
| $2.0\times10^2$ C/kg | 1000 Hz | 1.55 | x | $7.5\times10^{-5}$> | $1.3\times10^{-5}$ |
| | 2000 Hz | 1.58 | Δ | $1.9\times10^{-5}$> | $1.3\times10^{-5}$ |
| | 4000 Hz | 1.64 | ⊙ | $4.7\times10^{-6}$< | $1.3\times10^{-5}$ |
| | 8000 Hz | 1.75 | ⊙ | $1.2\times10^{-6}$< | $1.3\times10^{-5}$ |
| $3.0\times10^{-2}$ C/kg | 1000 Hz | 1.48 | x | $7.5\times10^{-5}$> | $8.3\times10^{-6}$ |
| | 2000 Hz | 1.51 | Δ | $1.9\times10^{-5}$> | $8.3\times10^{-6}$ |
| | 4000 Hz | 1.61 | ○ | $4.7\times10^{-6}$< | $8.3\times10^{-6}$ |
| | 8000 Hz | 1.74 | ⊙ | $1.2\times10^{-6}$< | $8.3\times10^{-6}$ |

This was very effective for drums increased in content of fluororesin powder according to the present invention.

Figure 12:
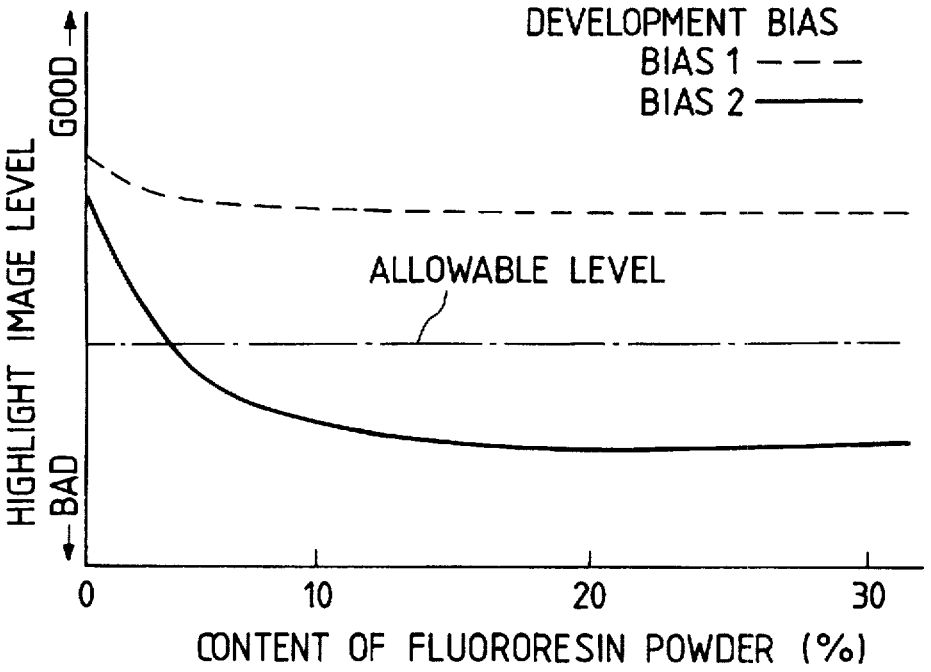
FIG. 12 is a graph to show a relation between content of fluororesin and image quality.

FIG. 12 shows an example in which the amplitude $V_{PP}$ of the alternating voltage intermittently given by the bias of FIG. 11 was 2000 V and the frequency $V_f$ was 8 kHz. FIG. 12 shows relations between the content of fluororesin powder and the highlight image level when the development bias in this example (bias 1) and the conventional bias of rectangular wave (bias 2) with the amplitude $V_{PP}$ of 2000 V and the frequency $V_f$ of 2 kHz were used.

Using the bias of this example, the level of highlight image is improved even for the image quality with the content of fluororesin being 0%, as compared with the conventional bias, while a characteristic part is that deterioration of image is little even with drums increased in the content of fluororesin powder which are to be used in this example.

This is strongly related to the condition of A<B as indicated by Table 3, which is described in the following.

Figure 17:
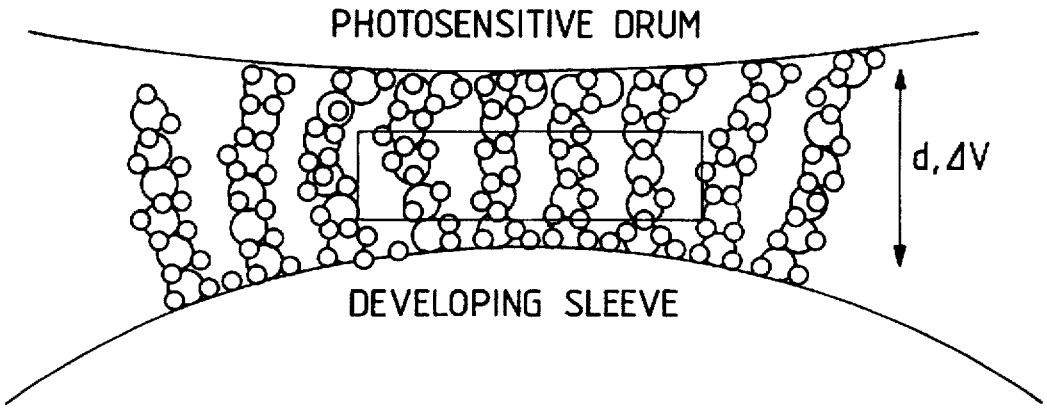
FIG. 17 is an explanatory drawing to show a force acting on toner.
Figure 18:
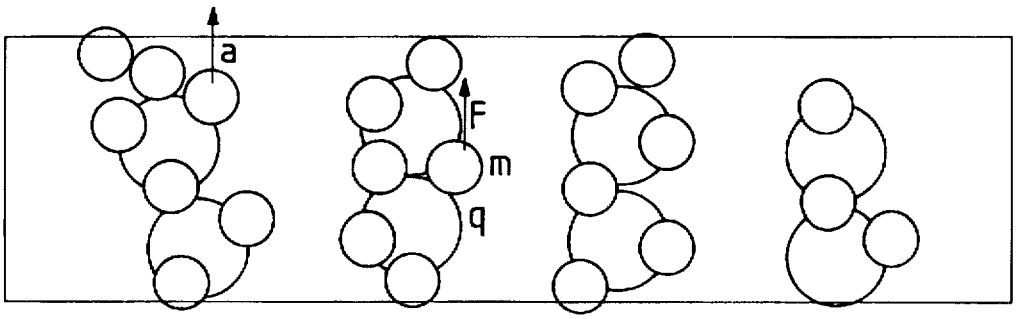
FIG. 18 is an enlarged explanatory drawing of FIG. 17.

FIG. 17 and FIG. 18 are drawings to show a force exerted on a toner particle on the development sleeve. In the drawings, q is a charge amount, m a mass, a an acceleration, ΔV a potential difference between the photosensitive drum and the development sleeve, and d a gap between the photosensitive drum and the development sleeve.

The alternating voltage from the development sleeve is applied to the toner for 1/(2VF) second every period. A distance X which the toner particle can move during this period can be calculated by the following formula (1).

$$X = (1/2)a(1/2V_f)^2 = (1/2)\{(|q|Vm)\cdot(\Delta V/d)\}(1/4V_f^2) \quad (1)$$
$$= (1/2)|Q|\cdot(\Delta V/d)\cdot(1/4V_f^2) = (|Q|\cdot\Delta V)/(8d\cdot V_f^2)$$

Also, a distance $X_+$ which the toner particle can move from the development sleeve to the photosensitive drum can be calculated by the following formula (2).

$$X_+=\{|Q|\cdot|(½)V_{PP}+V_{cont}|\}/(8d\cdot V_f^2) \quad (2)$$

Further, a distance X which the toner particle can move from the photosensitive drum to the development sleeve can be calculated by the following formula (3).

$$X_-=\{|Q|\cdot|(½)V_{PP}-V_{cont}|\}/(8d\cdot V_f^2) \quad (3)$$

Here, setting a condition under which the toner developed on the photosensitive drum cannot return to the development sleeve by the movement distance $X_-$ with application of a period of a peeling voltage, the toner remains biased on the photosensitive drum to repeat vibrating. This is because $X_+>X_-$.

This condition is defined by the condition given by the following formula (4) under which $X_-$ becomes smaller than the gap d between the photosensitive drum and the development sleeve.

$$\{|Q|\cdot|(½)V_{PP}-V_{cont}|\}/(8d\cdot V_f^2)<d \rightarrow (|V_{PP}-2V_{cont}|)/(16V_f^2)<d^2/|Q| \quad (4)$$

Performing the development under such a condition, the toner cannot move back and forth fully between the sleeve and the drum by one period of the alternating field and, when the alternating voltage is interrupted, the DC component works to draw the toner to the photosensitive drum in an amount according to the latent image potential, thereby causing no drop of dots. Repeating the intermittent vibration, the toner is concentrated in the latent image portion so as to faithfully reproduce each dot on the photosensitive drum, which enables the outputs a uniform image even for latent image so shallow as to have resulted in forming nonuniform images in the case of the conventional rectangular bias. In this manner, it became possible to obtain uniform images even with a drum for example containing 30% of the fluororesin.

For non-image portions, the voltage is normally set somewhat higher than the DC component in the development bias in order to avoid fog, as in the present embodiment. Because of this, $V_{cont}$ in formula 2 and formula 3 becomes negative in the non-image portions, so that $X_+<X_-$ there. Also, because the alternating voltage is interrupted, the DC component works to draw the toner to the sleeve, so that the toner is biased to the development sleeve, thereby causing no fog on the photosensitive drum.

Figure 13:
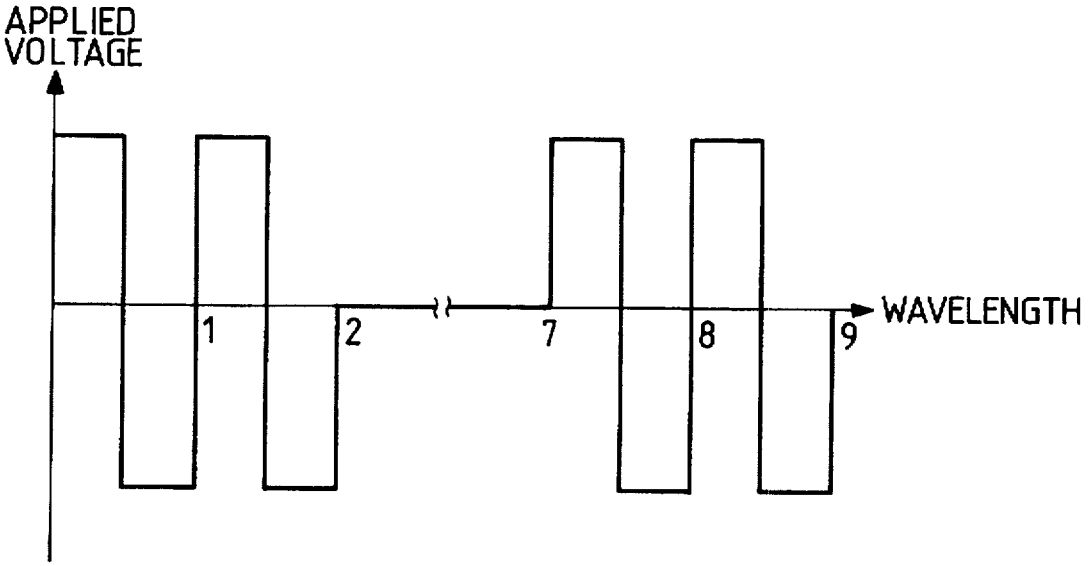
FIGS. 13 and 14 are waveform diagrams to show examples of the development bias voltage in the present embodiment.
Figure 14:
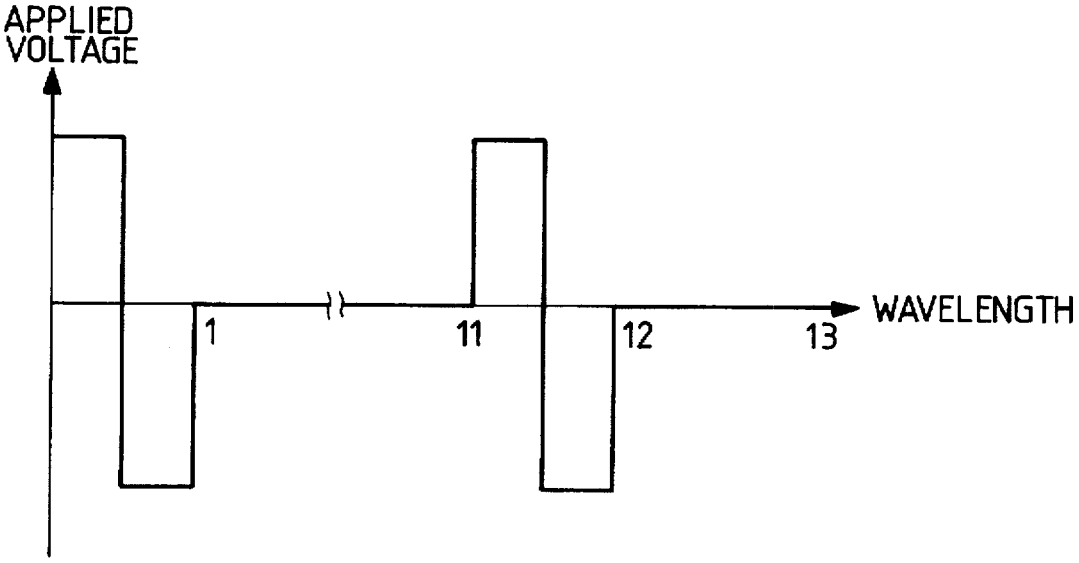

Although the present embodiment employed the alternating electric field applied as shown in FIG. 11, the present invention is by no means limited to this. For example, the applied voltage may be one having a cycle of two wave application and five wave quiescence as shown in FIG. 13 or one having a cycle of one wave application and ten wave quiescence as shown in FIG. 14. Further, the present embodiment used the rectangular wave, but application of various waves such as a triangular wave or a sine wave can be employed. A most appropriate application method can be selected depending upon the copy speed or development conditions. Preferable results were obtained when the ratio between the bias application time and the quiescent time was in the range of 1:1/2 to 1:15.

Next described is a method for producing the photosensitive member in this example.

A conductive coating was prepared by dispersing 50 weight parts of conductive titanium oxide powder coated with tin oxide containing 10% of antimony oxide, 25 weight parts of a phenol resin, 20 weight parts of methyl cellosolve, 5 weight parts of methanol, and 0.002 weight part of silicone oil (polydimethylsiloxane polyoxyalkylene copolymer, number-average molecular weight 3000) for two hours by a sand mill apparatus using glass beads of the diameter ϕ1 mm. The above coating was laid by dipping on an aluminum cylinder (diameter ϕ180 mm×360) and dried at 140° C. for 300 minutes to form a conductive layer in the thickness of 20 μm.

Next, a solution in which 30 weight parts of a methoxymethylated nylon resin (number-average molecular weight 32000) and 10 weight parts of an alcohol-soluble copolymerized nylon resin (number-average molecular weight 29000) were dissolved in a mixture solvent of 260 weight parts of methanol and 40 weight parts of butanol, was applied onto the above conductive layer by a dipping coating machine to form an undercoat layer in the thickness of 1 μm after being drained.

Then a coating for charge generating layer was prepared by dispersing 4 weight parts of a disazo pigment of the following structural formula [I],

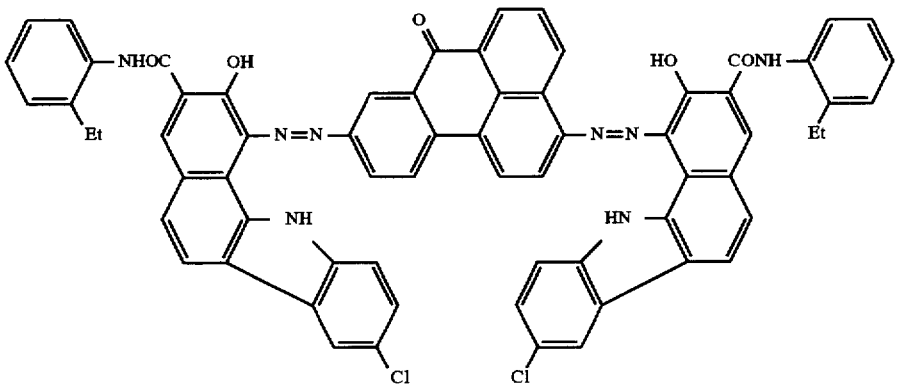

(I)

2 weight parts of a benzal resin, and 40 weight parts of tetrahydrofuran for 60 hours by the sand mill apparatus using glass beads of ϕ1 mm and thereafter diluting the resultant with a mixture solvent of cyclohexanone and tetrahydrofuran.

This coating solution was applied onto the undercoat layer by the dipping coating machine to form the charge generating layer in the thickness of 0.1 μm after dried.

Then 10 weight parts of a charge transfer medium of the following structural formula [II], and 10 weight parts of a polycarbonate resin (number-average molecular weight 25000) were dissolved in a mixture solvent of 20 weight parts of dichloromethane and 40 weight parts of monochlorobenzene.

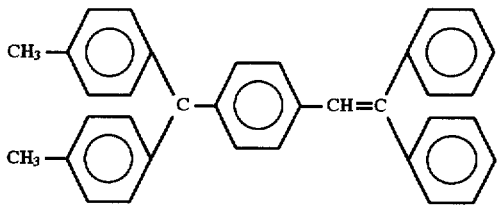

(II)

The resultant solution was applied onto the above charge generating layer by dipping and then was dried at 120° C. for 60 minutes to form the charge transfer layer in the thickness of 20 μm.

Next, 6 weight parts of a polycarbonate resin (number-average molecular weight 25000), 2 weight parts of the above charge transfer medium, and 2 weight parts of polytetrafluoroethylene (average primary particle size 0.3 μm) were dissolved in a mixture solvent of 200 weight parts of dichloromethane and 300 weight parts of monochlorobenzene. The resultant solution was applied by spraying onto the above charge transfer layer and then was dried at 120° C. for 60 minutes to form the surface protective layer in the thickness of 5 μm, thus forming the photosensitive member. In this case, a content of the fluororesin is 20% by weight relative to the weight of surface solid components.

The image formation was conducted under the conditions of ⓪ shown in FIG. 3 in the combination of toner and bias. In either case, the highlight portion was not roughened so as to obtain a sharp image and the durability stability was also assured as well as the cleanability.

The fluororesin applied in the present invention may be one or more suitably selected from tetrafluoroethylene resins, trifluorochloroethylene resins, tetrafluoroethylene-hexafluoropropylene resins, vinyl fluoride resins, difluorochloroethylene resins, and copolymers thereof. Particularly, a low-molecular-weight grade is preferable and primary particles are preferably not more than 0.3 μm.

As another embodiment, an electrophotographic photosensitive member was prepared under the same conditions as embodiment 1 except that the surface protective layer was omitted and 15% by weight of polytetrafluoroethylene particles (average primary particle size 0.3 μm) were included in the charge transfer layer. The photosensitive member was evaluated by conducting the same image formation. It was also confirmed in this case that stable images were able to be attained for a long period.

Next described is to use the surface layer of a binder resin or a hardening resin having the fluororesin dispersed, on the photosensitive member.

The binder resin for forming the surface layer may be any polymer substance having a film-forming property. Preferable materials are polymethacrylic acid ester (polymethacrylate), polystyrene, methacrylic acid ester and styrene copolymer, polycarbonate, polyester, polysulfone, etc. from the points that they have some hardness alone and that they do not hinder the carrier transfer.

The hardening resin may be one selected from thermosetting resins such as a polyurethane resin, an epoxy resin, a melamine resin, or a guanamine resin; and photo-setting resins represented by polyacrylates. However, when either one of these resins is singly used for the surface layer, the cleanability is poor because of their low surface lubricity. Therefore, the fluororesin is dispersed in either one of these resins form a the surface layer improved in surface lubricity and thus satisfying the above property.

Figures 15A, 15B, 15C, 15D, 15E:
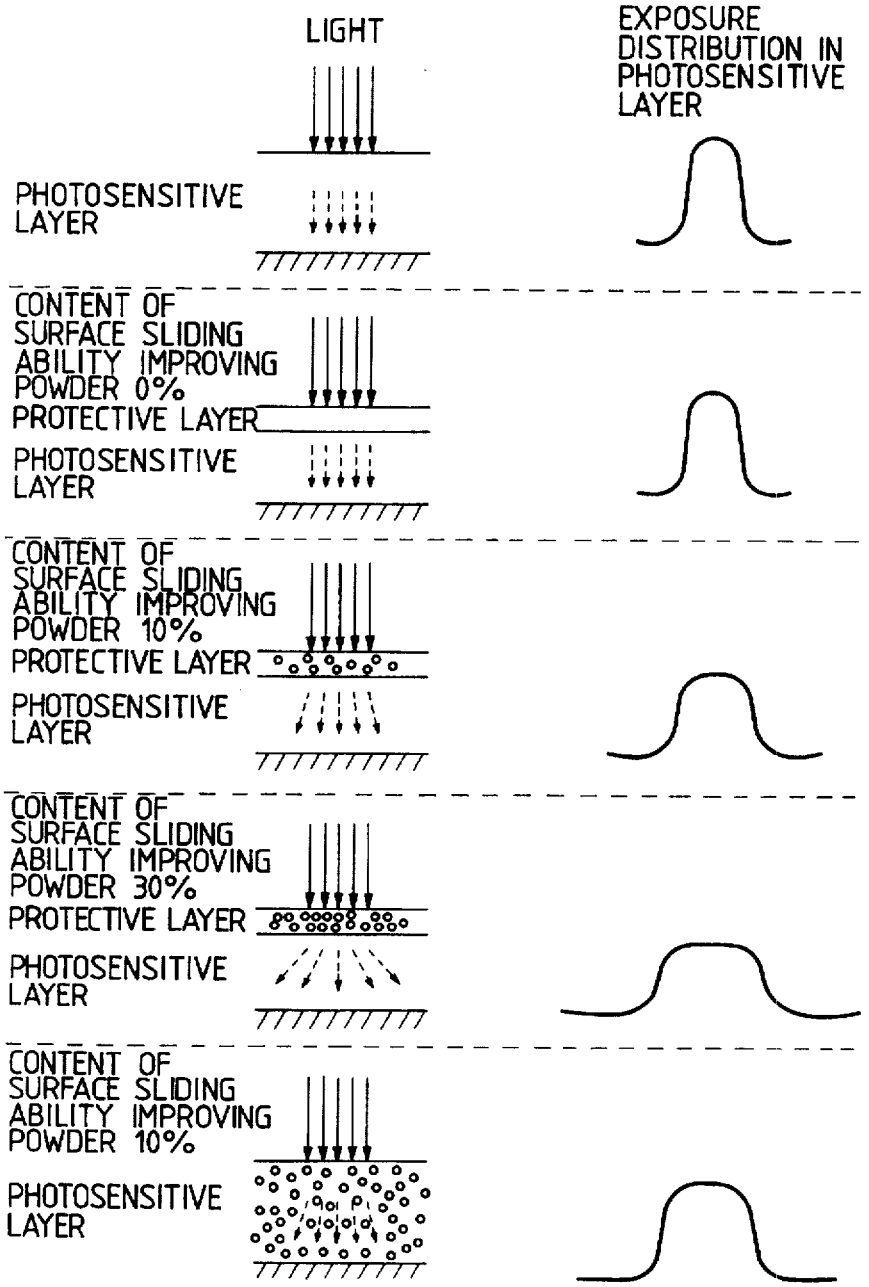
FIGS. 15A to 15E are explanatory drawings to illustrate scattering of light by the fluororesin on the photosensitive member.

FIGS. 15A to 15E are explanatory drawings to illustrate the case where the protective layer is formed on the photosensitive member. Where the protective layer of the binder resin or hardening resin is simply formed on the surface of the photosensitive member, an exposure distribution in the photosensitive member is rarely broadened as compared with the case without a protective layer, as shown in FIGS. 15A and 15B, because the exposure light projected onto the drum is not scattered in the protective layer.

However, if surface-lubricity-improving powder is added, the exposure distribution in the photosensitive layer becomes broadened.

It is preferred that the content of the fluororesin be not less than 10% of the solid content weight of the surface layer.

Figure 16:
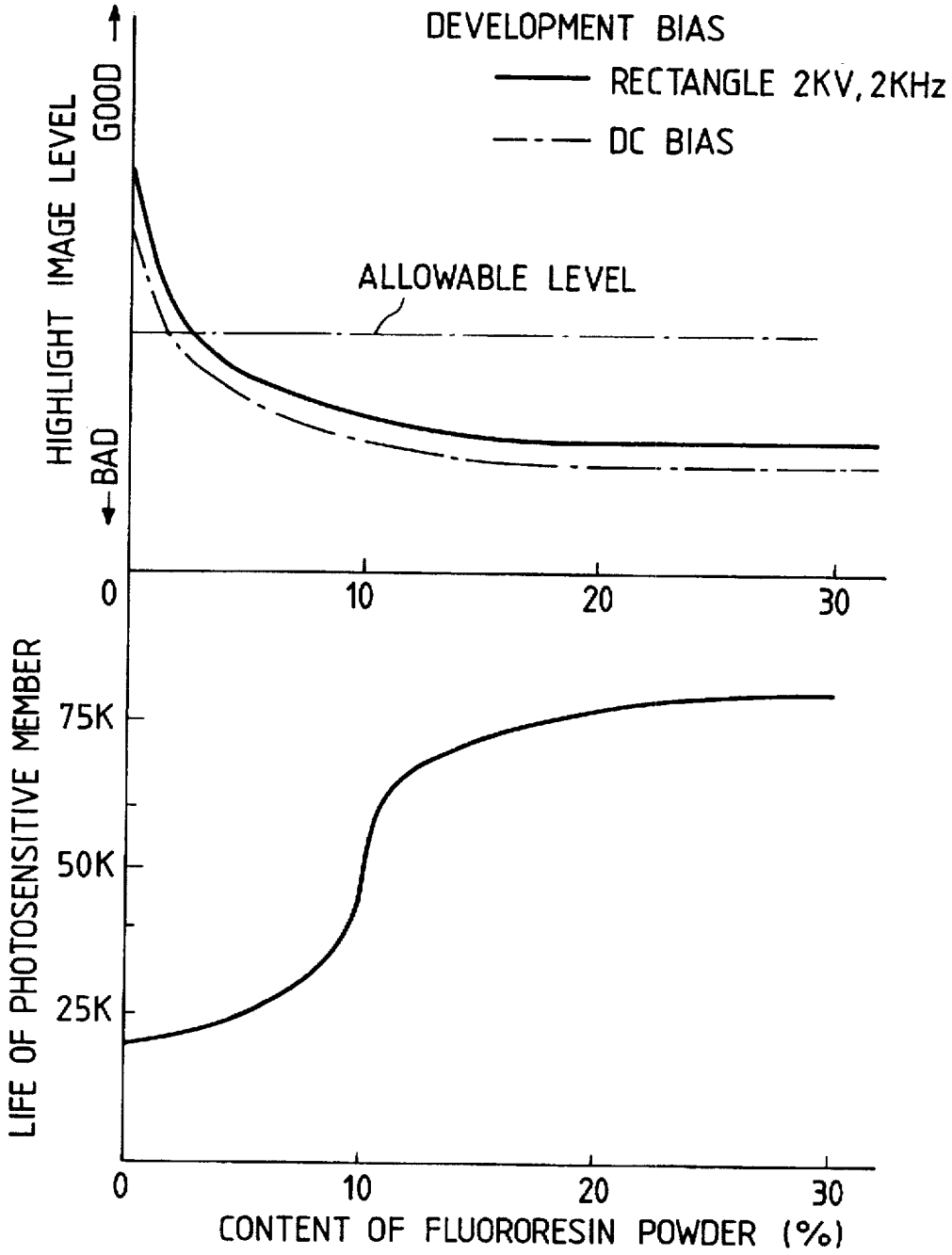
FIG. 16 is graphs to show relations between content of fluororesin and life of photosensitive member or image quality.

FIG. 16 shows relations between the weight ratio of the fluororesin relative to the solid content weight of the surface layer, and the life of the photosensitive member or the highlight image level. The life of photosensitive member is a life before scratches appear on the drum or before poor cleaning occurs. Although it depends upon the structure of the cleaning device, there is a point of inflection near the content 10% and the life tends to go into saturation slowly above 10%. This can be considered as follows.

It is considered that the fluororesin improves the surface lubricity as a lubricant and that a friction coefficient cannot decrease so much unless it is fully dispersed over the surface, thereby failing to improve the durability. Thus, the effect due to the addition of the fluororesin becomes outstanding when the fluororesin is contained in an amount not less than 10% by weight relative to the solid content weight of surface layer. Namely, at least 10% of the fluororesin needs to be contained in order to achieve a satisfactory effect on durability.

The fluororesin used herein is selected to have primary particles not more than 0.3 μm. Even if so selected, the scattering of incident light cannot be prevented. For example, as shown in FIGS. 15C or 15D, the incident light is scattered because of the fluororesin in the protective layer, thus broadening the exposure distribution in the photosensitive layer. As a result, a resultant latent image becomes a latent image shallow in respect of potential.

The content of the fluororesin and the development bias are described in more detail in the following.

Since an increase in the fluororesin content results in formation of shallow latent image as described above, the toner with low triboelectricity cannot be transferred onto a latent image within a short time period of interruption of the alternating voltage during a time between the interruption of the alternating voltage and application of the pullback voltage, and therefore unevenness of triboelectricity is reflected as unevenness of dots as it is, resulting in forming a nonuniform image.

Here, it seems that this problem can be solved by extending the application time of the alternating voltage in the direction for the developer to move from the development sleeve to the photosensitive drum, instead of extending the time period for interruption of the alternating voltage. However, by simply extending the application time, the toner in the non-image portions is also transferred, whereby a uniform image can be obtained but fog also appears, thus not solving the problem.

On the other hand, a too long time period for interruption of the alternating voltage would result in insufficient vibration in the development. As the photosensitive member increases the content of the fluororesin, thus forming a shallow latent image, the number of vibrations needs to be increased to obtain a uniform image, which defines the upper limit of the time period for interruption of the alternating voltage.

A lot of investigations were carried out on the relations between the application time of the alternating voltage and the time period of interruption of the alternating voltage to achieve uniform dot reproducibility, and the content of the fluororesin, within the range of frequency satisfying the previously described condition of A<B, whereby the following relation was obtained.

Namely, where the application time of the alternating voltage was $T_1$ [sec], the time period of interruption of the alternating voltage $T_2$ [sec], and the content of the fluororesin F [weight %], images were obtained with sufficiently uniform image quality of highlight if the following relation was satisfied.

$$6-(F/10)^{1/2}>T_2/T_1>(F/10)^{1/2}$$

As described previously, the stable cleanability cannot be achieved unless the content of fluororesin is at least 10%. If it is over 40%, the latent image becomes out of focus, thus failing to obtain a sufficiently uniform image even with use of the above bias. Thus, uniform images can be stably attained selecting the content within the following range.

$$10<F \text{ [weight \%]} <40$$

Figure 19:
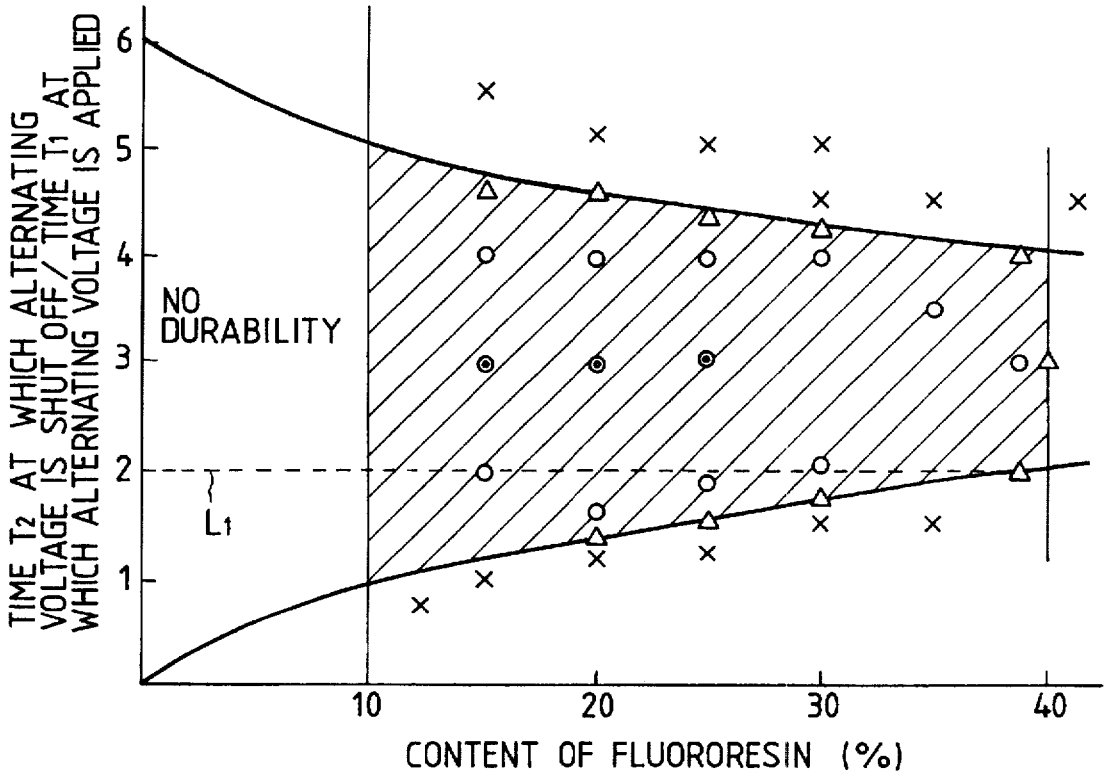
FIG. 19 is a graph to show optimum development conditions in a relation between the content of fluororesin and the ratio between a time period for which an alternating voltage is interrupted and a time period for which the voltage is applied.

The graph of FIG. 19 shows a relation between the content of the fluororesin, and a ratio $T_2/T_1$ between the time period $T_2$ for interruption of the alternating voltage and the time period $T_1$ for application of the alternating voltage, and a range of optimum development conditions in the present embodiment. In the drawing, the hatched portion is the applicable range of the present invention. Satisfying this condition, stable images can be obtained without roughness of highlight. In the drawing, ⊚, ○, Δ, × represent levels of highlight image when images are produced under some conditions in the drawing with frequency satisfying the condition of A<B where $A=|V_{PP}-2V_{cont}|/16V_f^2$ and $B=d^2/|Q|$.

Also, the dotted line $L_1$ shown in FIG. 19 represents the condition at the development bias of FIG. 11, and the relation between the image quality of this portion and the content of the fluororesin is shown in FIG. 16.

For the non-image portions, the voltage is normally set higher than the DC component in the development bias in the present embodiment in order to avoid fog. Thus, because $V_{cont}$ becomes negative in the non-image portions, $X_+<X_-$ there. Further, because the alternate voltage is interrupted, the DC component works to draw the toner to the sleeve, so that the toner is biased further toward the development sleeve, thereby preventing fog from appearing on the photosensitive drum.

The embodiments of the present invention were described above, but it should be noted that the present invention is by no means limited to the above embodiments but may include all modifications within the technical concept of the invention.

What is claimed is:

1. An image forming apparatus comprising:

an image carrying member for carrying an electrostatic image, said image carrying member having a photosensitive layer and a surface layer containing a fluororesin; and developing means for developing the electrostatic image on said image carrying member, said developing means having a developer carrying member for carrying a developer, arranged as opposed to said image carrying member, and bias applying means for applying a development bias voltage to said developer carrying member;

wherein a period of a waveform of the bias voltage applied by said bias applying means has an oscillating part and a quiescent part and wherein the following formula is satisfied:

$$|V_{PP}-2V_{cont}|/16V_f^2<d^2/|Q|$$

where $V_{PP}$: peak-to-peak value (V) of the development bias voltage;

$V_f$: a frequency (Hz) of the development bias;

$V_{cont}$: a image contrast potential (V);

Q: an average triboelectricity (C/kg) of the toner;

d: a distance (m) between the image carrying member and the developer carrying member.

2. An image forming apparatus according to claim 1, wherein the developer is a two-component developer having a toner and a carrier.

3. An image forming apparatus according to claim 1, wherein the bias voltage is a voltage in which an AC component is intermittently superimposed on a DC component.

4. An image forming apparatus according to claim 1, wherein the bias voltage is substantially a rectangular wave.

5. An image forming apparatus according to claim 1, wherein a period of the waveform of the bias voltage comprises a plurality of oscillations and a quiescent part.

6. An image forming apparatus according to claim 1, wherein a primary particle size of the fluororesin is not more than 0.3 μm.

7. An image forming apparatus according to claim 1, wherein said surface layer contains at least 10% by weight of the fluororesin.

8. An image forming apparatus according to claim 1, wherein the following formulas are satisfied:

$$6-(F/10)^{1/2}>T_2/T_1>(F/10)^{1/2},\ 10<F<40;$$

$T_1$: a time period (sec) of the oscillating part;

$T_2$: a time period (sec) of the quiescent part;

F: a content (weight %) of the fluororesin.

9. An image forming apparatus according to claim 1, wherein a ratio between the oscillating part and the quiescent part is in the range of 1:1/2 to 1:15.

* * * * *

UNITED STATES PATENT AND TRADEMARK OFFICE

CERTIFICATE OF CORRECTION

PATENT NO. : 5,752,140

DATED : May 12, 1998

INVENTOR(S) : TOSHIMITSU DANZUKA ET AL.

It is certified that error appears in the above-identified patent and that said Letters Patent is hereby corrected as shown below:

On the title page

[73] AT ASSIGNEE:

"Canon Kabushiki Kaisha, Japan " should read --Canon Kabushiki Kaisha, Tokyo, Japan--.

[56] AT U.S. PATENT DOCUMENTS:

Insert --5,294,959 3/1994 Nagao et al.--.

[57] AT ABSTRACT:

Line 2 "fluororesin has " should be deleted.
Line 3 "a surface layer containing a fluororesin," should be deleted.

COLUMN 1:

Line 11, "general" should read --general practice--.

COLUMN 2:

Line 24, "compensate," should read --to compensate,--.

COLUMN 5:

Line 43, "of" should be deleted.

COLUMN 11:

Line 11, "X" should read --X.--.
Line 39, "outputs" should read --output of a--.

UNITED STATES PATENT AND TRADEMARK OFFICE

CERTIFICATE OF CORRECTION

PATENT NO. : 5,752,140

DATED : May 12, 1998

INVENTOR(S) : TOSHIMITSU DANZUKA ET AL.

It is certified that error appears in the above-identified patent and that said Letters Patent is hereby corrected as shown below:

Column 11:
Line 39, "outputs" should read --output of --.
Column 13:
Line 3, "after" should read --after being--.

COLUMN 14:

Line 5, "resins form a the" should read --resins to form a--.

COLUMN 15:

Line 14, "previously described" should be --previously-described--.

[*] AT NOTICE:

"5,242,812" should read --5,424,812--.

Signed and Sealed this

Fourth Day of May, 1999

*Attest:*

Q. TODD DICKINSON

*Attesting Officer*

*Acting Commissioner of Patents and Trademarks*